US009837799B2

(12) United States Patent
Suzuki

(10) Patent No.: US 9,837,799 B2
(45) Date of Patent: Dec. 5, 2017

(54) SPARK PLUG

(71) Applicant: NGK SPARK PLUG CO., LTD., Nagoya-shi, Aichi (JP)

(72) Inventor: Kaori Suzuki, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/317,596

(22) PCT Filed: Jun. 15, 2015

(86) PCT No.: PCT/JP2015/002984

§ 371 (c)(1),
(2) Date: Dec. 9, 2016

(87) PCT Pub. No.: WO2016/002143

PCT Pub. Date: Jan. 7, 2016

(65) Prior Publication Data

US 2017/0125981 A1 May 4, 2017

(30) Foreign Application Priority Data

Jun. 30, 2014 (JP) ..... 2014-133806

(51) Int. Cl.

| | |
|---|---|
| ***H01T 13/20*** | (2006.01) |
| ***H01T 13/39*** | (2006.01) |
| ***H01T 13/32*** | (2006.01) |

(52) U.S. Cl.
CPC ..... *H01T 13/39* (2013.01); *H01T 13/32* (2013.01)

(58) Field of Classification Search
CPC ..... H01T 13/39; H01T 13/32; H01T 13/20
See application file for complete search history.

(56) References Cited

U.S. PATENT DOCUMENTS

| | | | | |
|---|---|---|---|---|
| 2012/0112619 | A1 | 5/2012 | Kasuya et al. | 313/141 |
| 2013/0221832 | A1 | 8/2013 | Ishiguro et al. | 313/144 |

FOREIGN PATENT DOCUMENTS

| | | | | |
|---|---|---|---|---|
| JP | 2012-099396 | A | 5/2012 | H01T 13/20 |
| JP | 2013-178912 | A | 9/2013 | H01T 13/20 |
| JP | 2013-206789 | A | 10/2013 | H01T 13/20 |

OTHER PUBLICATIONS

International Search Report issued in corresponding International Patent Application No. PCT/JP2015/002984, dated Aug. 25, 2015.

*Primary Examiner* — Donald Raleigh
(74) *Attorney, Agent, or Firm* — Kusner & Jaffe

(57) ABSTRACT

A spark plug including an electrode having a cylindrical precious metal tip welded thereto, the electrode having a melt portion in which the precious metal tip and the electrode base material are melted, wherein the melt portion includes a melt sag over an entire circumference on a side surface of the precious metal tip.

4 Claims, 5 Drawing Sheets

| | TIP MATERIAL | TIP SIZE (mm) | NUMBER |
|---|---|---|---|
| SPEC 1 | Ir-Pt | $\phi$0.6×0.75 | 6 |
| SPEC 2 | Ir-Rh | $\phi$0.6×0.75 | 6 |
| SPEC 3 | Ir-Ru | $\phi$0.6×0.75 | 6 |
| SPEC 4 | Ir-Pt | $\phi$0.8×0.5 | 6 |
| SPEC 5 | Ir-Rh | $\phi$0.8×0.5 | 6 |
| SPEC 6 | Ir-Ru | $\phi$0.8×0.5 | 6 |

SPARK PLUG

RELATED APPLICATIONS

This application is a National Stage of International Application No. PCT/JP15/02984 filed Jun. 15, 2015, which claims the benefit of Japanese Patent Application No. 2014-133806, filed Jun. 30, 2014.

FIELD OF THE INVENTION

The present invention relates to spark plugs.

BACKGROUND OF THE INVENTION

As a conventional spark plug, a spark plug has been known which includes an electrode (a center electrode or a ground electrode) to which an electrode tip (hereinafter referred to as "precious metal tip") formed of a precious metal or an alloy containing a precious metal as a main component is joined (see Japanese Patent Application Laid-Open (kokai) No. 2013-178912, for example). Generally, a precious metal tip is joined to an electrode base material by laser welding. Specifically, the precious metal tip is irradiated with a laser beam along its outer periphery, whereby the precious metal tip is joined to the electrode base material. When the precious metal tip is welded to the electrode base material, usually, a melt portion in which the material of the precious metal tip and the material of the electrode base material are melted is formed between the precious metal tip and the electrode base material.

As described above, in the spark plug including the precious metal tip, at an interface (hereinafter also referred to as a melt portion interface) between the melt portion and the precious metal tip, an oxide film (hereinafter also referred to as an oxide scale) may be formed on the surface of the melt portion. The oxide scale is formed, at the melt portion interface, so as to gradually grow from an outer peripheral portion near the outside air toward the inside of the melt portion interface.

When the spark plug is used, heating and cooling cycles are repeated, whereby a stress is caused by a difference in thermal expansion coefficient between the precious metal tip and the electrode base material, near a joint portion of the precious metal tip and the electrode base material. Generally, an oxide scale is lower in strength (is more fragile) than the melt portion or the precious metal tip. Therefore, when a stress occurs as described above, crack is likely to occur in the oxide scale having the relatively low strength. When crack occurs in the oxide scale and the air enters the crack, oxidation of the melt portion interface progresses, and the oxide scale further grows toward the inside of the melt portion interface. The growth of the oxide scale toward the inside of the melt portion interface causes the crack to extend toward the inside of the melt portion interface, leading to falling off of the precious metal tip, which makes it difficult to secure reliability of the joint between the precious metal tip and the electrode base material.

Conventionally proposed measures to improve the reliability of the joint between the precious metal tip and the electrode base material are: forming the melt portion to be thicker; and adjusting the shape of the melt portion to suppress the stress that occurs between the precious metal tip and the electrode base material (refer to Patent Document 1, for example). Since the melt portion has an intermediate composition between the precious metal tip and the electrode base material, a difference in thermal expansion coefficient between the precious metal tip and the melt portion is smaller than the difference in thermal expansion coefficient between the precious metal tip and the electrode base material. Therefore, for example, by increasing the thickness of the melt portion, a stress that occurs near the interface between the precious metal tip and the melt portion can be suppressed, and crack is suppressed from occurring in the oxide scale due to the stress.

However, measures to suppress growth of the oxide scale at the interface between the precious metal tip and the electrode base material have not been sufficiently investigated. Therefore, it has been desired to suppress growth of the oxide scale and improve the reliability of the joint between the precious metal tip and the electrode base material.

SUMMARY OF THE INVENTION

The present invention is made to address, at least partially, the above problem, and can be embodied in the following modes.

(1) According to one aspect of the present invention, a spark plug is provided which includes an electrode obtained by welding a cylindrical precious metal tip which contains a precious metal and allows discharge at an end surface on one end side with respect to a center axis thereof, to an electrode base material disposed on the other end side, in a direction of the center axis, with respect to the precious metal tip. The electrode has a melt portion in which the precious metal tip and the electrode base material are melted, between the other end of the precious metal tip and the electrode base material. The melt portion of the spark plug includes a melt sag over an entire circumference on a side surface of the precious metal tip. Further, in this spark plug, in an arbitrary cross section, including the center axis, of the electrode: a length of a line S corresponding to the end surface on the one end side of the precious metal tip is D; two straight lines apart from the center axis by a distance of "9D/20" are virtual straight lines L1, L2, respectively; an intersection point of each virtual straight line L1, L2 and an interface between the precious metal tip and the melt portion is an intersection point P1, P2, respectively; a straight line connecting the intersection points P1 and P2 is a virtual straight line L3; of both end points of the line S, the end point located on the same side as the virtual straight line L1 with respect to the center axis is an end point P3, and the end point located on the same side as the virtual straight line L2 with respect to the center axis is an end point P4; a straight line passing each end point P3, P4 and parallel to the center axis is a virtual straight line L4, L5, respectively; of end points of the melt sag at the one end side on the virtual straight lines L4 and L5, the end point on the virtual straight line L4 is an end point P5, and the end point on the virtual straight line L5 is an end point P6; an intersection point of each virtual straight line L4, L5 and the virtual straight line L3 is an intersection point P7, P8, respectively; and each of a distance X1 between the intersection point P7 and the end point P5 and a distance X2 between the intersection point P8 and the end point P6 is 0.092 mm or more. According to the spark plug of this mode, since the melt sag having a predetermined shape is formed over the entire circumference on the side surface of the precious metal tip, entry of the air into the interface between the precious metal tip and the melt portion can be suppressed, thereby suppressing formation of an oxide scale at the interface between the precious metal tip and the melt portion. As a result, when the heating and cooling cycles are repeated in the spark plug, it is possible to suppress occurrence of crack due to a difference in thermal expansion coefficient between the precious metal tip and the electrode base material at the interface between the precious metal tip and the melt portion, whereby reliability of the joint between the precious metal tip and the electrode base material can be improved.

(2) In accordance with a second aspect of the present invention, there is provided a spark plug, as described above, wherein each of the distances X1 and X2 may be 0.110 mm or more. According to the spark plug of this mode, growth of the oxide scale at the interface between the precious metal tip and the melt portion is more suppressed, whereby reliability of the joint between the precious metal tip and the electrode base material can be further improved.

The present invention can be embodied in various forms other than the spark plug. For example, the present invention can be embodied in forms of an internal combustion engine on which the spark plug is mounted, a vehicle including the internal combustion engine, and the like. Further, the present invention can be embodied in the form of a method for manufacturing the spark plug.

DETAILED DESCRIPTION OF THE PREFERRED EMBODIMENTS

Figure 1:
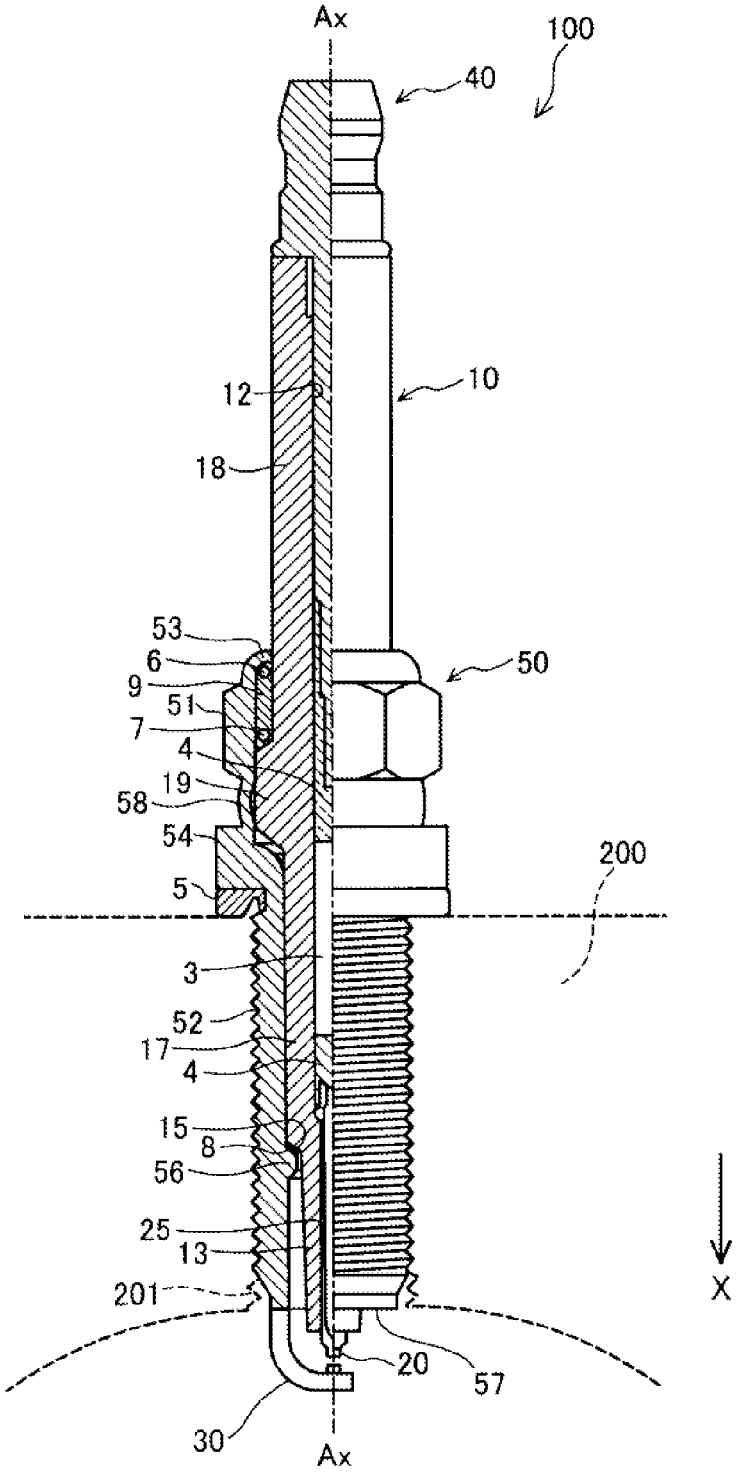
FIG. 1 is a partially cross-sectional view of a spark plug.

A. Schematic Structure of Spark Plug:

FIG. 1 is a partially cross-sectional view of a spark plug 100 as an embodiment of the present invention. The spark plug 100 has an elongated shape extending along an axis Ax (a center axis of the spark plug 100). In FIG. 1, the right side of the axis Ax indicated by a dot-dash line shows an exterior front view, and the left side of the axis Ax shows a sectional view where the spark plug 100 is sectioned by a plane that passes the axis Ax. In the following description, in a direction parallel to the axis Ax, the lower side in FIG. 1 (indicated by an arrow X in FIG. 1) is referred to as the front side, and the upper side in FIG. 1 is referred to as the rear side.

The spark plug 100 includes a ceramic insulator 10, a center electrode 20, a ground electrode 30, a metal terminal 40, and a metallic shell 50. The rod-shaped center electrode 20 projecting from a front end of the ceramic insulator 10 extends through the interior of the ceramic insulator 10 and is electrically connected to the metal terminal 40 provided at a rear end of the ceramic insulator 10. The outer periphery of the center electrode 20 is held by the ceramic insulator 10, and the outer periphery of the ceramic insulator 10 is held by the metallic shell 50 at a position apart from the metal terminal 40.

The ground electrode 30 electrically connected to the metallic shell 50 forms a spark gap which is a gap for generating a spark, between the ground electrode 30 and the front end of the center electrode 20. The spark plug 100 is attached, through the metallic shell 50, to a threaded attachment hole 201 provided in an engine head 200 of an internal combustion engine. When a high voltage of 20,000 to 30,000 V is applied to the metal terminal 40, a spark is generated at the spark gap formed between the center electrode 20 and the ground electrode 30.

The ceramic insulator 10 is an insulator formed through firing of a ceramic material such as alumina. The ceramic insulator 10 is a cylindrical member having, in the center thereof, an axial hole 12 in which the center electrode 20 and the metal terminal 40 are accommodated. The ceramic insulator 10 has a central trunk portion 19 formed at the center thereof in the axial direction and having an increased outer diameter. A rear trunk portion 18 for insulation between the metal terminal 40 and the metallic shell 50 is formed on the metal terminal 40 side relative to the central trunk portion 19. A front trunk portion 17 having an outer diameter smaller than that of the rear trunk portion 18 is formed on the center electrode 20 side relative to the central trunk portion 19. A leg portion 13 having an outer diameter which is smaller than that of the front trunk portion 17 and decreases toward the front side is formed frontward of the front trunk portion 17.

The metallic shell 50 is a cylindrical metallic member that surrounds a portion of the ceramic insulator 10 extending from a part of the rear trunk portion 18 to the leg portion 13 to hold the ceramic insulator 10. In the present embodiment, the metallic shell 50 is formed of low carbon steel, and the entirety of the metallic shell 50 is subjected to plating such as nickel plating or zinc plating. The metallic shell 50 has a tool engagement portion 51, a threaded attachment portion 52, and a gasket receiving portion 54.

A tool (not shown) used for fixing the spark plug 100 to an engine head 200 is engaged with the tool engagement portion 51 of the metallic shell 50. The threaded attachment portion 52 of the metallic shell 50 has a screw thread to be screwed into the threaded attachment hole 201 of the engine head 200. The gasket receiving portion 54 of the metallic shell 50 projects radially outward relative to the threaded attachment portion 52 and is formed in a flange shape, on the rear side of the threaded attachment portion 52.

In addition, a gasket 5 which is a substantially annular-shaped solid member is fitted to the metallic shell 50 so as to be in contact with a front-side end portion of the gasket receiving portion 54. The gasket 5 secures sufficient seal between the gasket receiving portion 54 of the spark plug 100 and the engine head 200. A front end surface 57 of the metallic shell 50 is formed in a circular shape having an opening in a center portion thereof. At the center portion, the center electrode 20 projects from the leg portion 13 of the ceramic insulator 10.

A thin crimp portion 53 is provided on the rear side of the metallic shell 50 with respect to the tool engagement portion 51. In addition, a compressive deformation portion 58, as thin as the crimp portion 53, is provided between the gasket receiving portion 54 and the tool engagement portion 51. Annular ring members 6 and 7 are interposed between an inner peripheral surface of the metallic shell 50 from the tool engagement portion 51 to the crimp portion 53, and an outer peripheral surface of the rear trunk portion 18 of the ceramic insulator 10. Further, powder of talc 9 is charged between the ring members 6 and 7.

When the spark plug 100 is manufactured, crimping is performed in which the crimp portion 53 is bent inward and pressed frontward, whereby the compressive deformation portion 58 is compressed and deformed. As a result of the crimping, the ceramic insulator 10 is pressed frontward in the metallic shell 50 through the ring members 6 and 7 and the talc 9. As a result of this pressing, the talc 9 is compressed in the direction of the axis Ax, whereby the airtightness of the metallic shell 50 is improved.

At the inner periphery of the metallic shell 50, a ceramic step portion 15 located at a base end of the leg portion 13 of the ceramic insulator 10 is pressed, through a ring-shaped sheet packing 8, against a metal-shell internal step portion 56 formed at the position of the threaded attachment portion 52. The sheet packing 8 is a member for maintaining airtightness between the metallic shell 50 and the ceramic insulator 10, and prevents combustion gas from flowing out.

The center electrode 20 includes an electrode base material 25 which is a rod-shaped member extending in the direction of the axis Ax. The electrode base material 25 is formed of a nickel alloy containing nickel as a main component. In the present embodiment, the electrode base material 25 has, therein, a core member formed of a material having higher thermal conductivity than the electrode base material 25, such as copper or an alloy containing copper as a main component. The center electrode 20 according to the present embodiment further includes, at a front end of the electrode base material 25, a precious metal tip for improving resistance to spark-induced erosion and resistance to oxidation-induced erosion. The structure of the front end portion of the center electrode 20 will be described later in detail. The center electrode 20 is inserted in the axial hole 12 of the ceramic insulator 10, with the front end of the electrode base material 25 projecting from the axial hole 12 of the ceramic insulator 10, and is electrically connected to the metal terminal 40 through a ceramic resistor 3 and a seal body 4.

The ground electrode 30 is a rod-shaped member, and has a base end welded to the front end surface 57 of the metallic shell 50. The front side of the ground electrode 30 is bent in a direction intersecting the axis Ax, and the front end portion of the ground electrode 30 faces the front end surface of the center electrode 20 on the axis Ax. A precious metal tip similar to the center electrode 20 may be provided at a position opposed to the center electrode 20 at the front end portion of the ground electrode 30.

Figure 2A:
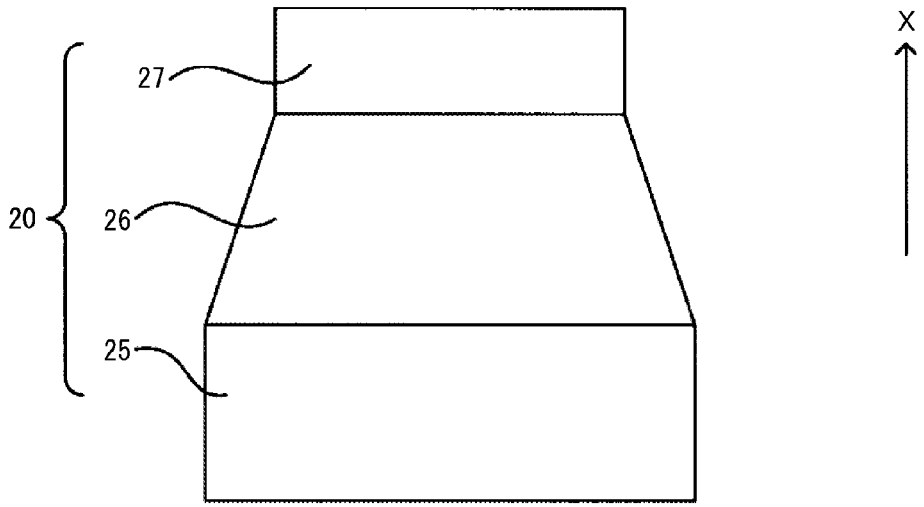
FIGS. 2(A) and 2(B) are enlarged explanatory views showing the structure of a front end portion of a center electrode.
Figure 2B:
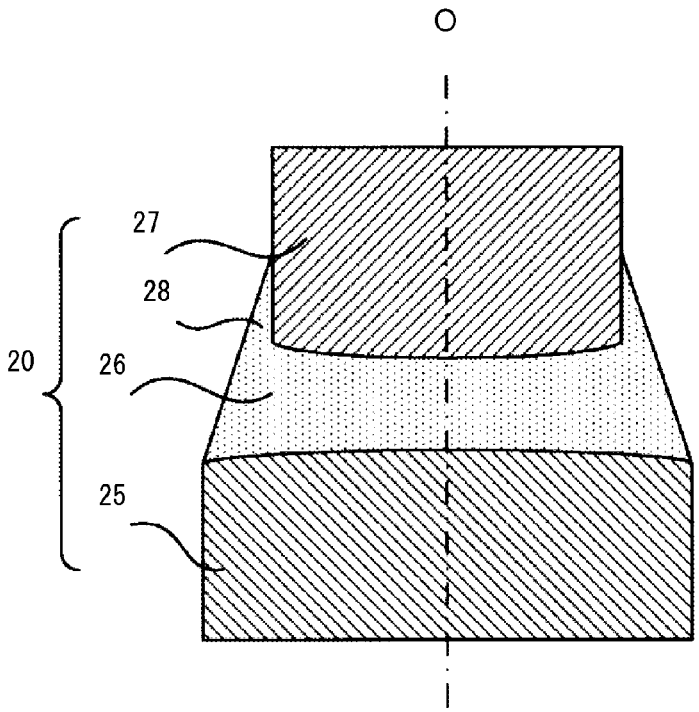

B. Structure of Precious Metal Tip and its Vicinity:

FIGS. 2(A) and 2(B) are enlarged explanatory views showing the structure of the front end portion of the center electrode 20. FIG. 2(A) is a side view showing the appearance of the front end portion of the center electrode 20, and FIG. 2(B) is a cross-sectional view showing a cross section including a center axis O of a precious metal tip 27 included in the center electrode 20. In FIG. 2(A), the above-described front side of the spark plug 100 is indicated by an arrow X. In the spark plug 100 according to the present embodiment, the center axis O of the precious metal tip 27 coincides with the axis Ax as the center axis of the spark plug 100.

The precious metal tip 27 is a cylindrical member formed of a precious metal (e.g., platinum, iridium, ruthenium, rhodium, or the like) or an alloy containing not less than 50 wt % of a precious metal as a main component, and is joined to the front end surface of the electrode base material 25 by laser welding. Therefore, a melt portion 26 in which the electrode base material 25 and the precious metal tip 27 are melted is formed between the front end surface of the electrode base material 25 and the precious metal tip 27. In the present embodiment, the melt portion 26 is formed so as to cover the entire front end surface of the electrode base material 25.

In the precious metal tip 27 welded to the electrode base material 25, the diameter of the cross section perpendicular to the center axis O (the diameter of the end surface on the front side) can be, for example, 0.3 mm or more, and preferably 0.4 mm or more. In addition, the diameter of the cross section of the precious metal tip 27 can be, for example, 1.5 mm or less, and preferably 1.2 mm or less. In addition, in the electrode base material 25, the front end surface to which the precious metal tip 27 is joined may have a size enough to be in contact with the entire rear end surface of the precious metal tip 27. For example, when the electrode base material 25 is a cylindrical member, the diameter of the front end surface of the electrode base material 25 may be about 0.2 to 0.4 mm larger than the diameter of the rear end surface of the precious metal tip 27, in terms of facilitating welding.

Further, in the present embodiment, a melt sag 28 is formed in the melt portion 26. When the electrode base material 25 and the precious metal tip 27 are melted and thereby the melt portion 26 is formed, the melt sag 28 is formed as a portion of a melt forming the melt portion 26. That is, the melt sag 28 is formed such that a portion of the melt extends frontward along the side surface of the precious metal tip 27, from near the interface between the electrode base material 25 and the precious metal tip 27, when the electrode base material 25 and the precious metal tip 27 are welded (refer to FIG. 2(B)). In the present embodiment, the melt sag 28 is formed over the entire circumference on the side surface of the precious metal tip 27.

Welding of the electrode base material 25 and the precious metal tip 27 may be performed by bringing the front end surface of the electrode base material 25 into contact with the rear end surface of the precious metal tip 27, and irradiating an area including the contact portions thereof, with a laser beam, from the outer peripheral side of the precious metal tip 27 toward the inside thereof. In the present embodiment, the irradiation with the laser beam is performed from the outer peripheral side of the precious metal tip 27 toward the center axis O of the precious metal tip 27. It is desirable that the irradiation with the laser beam is uniformly performed over the entire circumference of the precious metal tip 27.

Welding of the electrode base material 25 and the precious metal tip 27 may employ various devices capable of emitting laser beams, such as a YAG laser, a carbon dioxide gas laser, a semiconductor laser, and a fiber laser. The employed laser may be a pulse wave (PW) oscillation laser or a continuous wave (CW) oscillation laser. In welding, in order to form the melt sag 28 having a desired shape described later, for example, it is desirable that the amount of energy per irradiation width is increased in a profile of the laser beam. In order to increase the amount of energy per irradiation width in the profile of the laser beam, for example, a lens or an oscillator in the laser irradiation device may be optimized, and a condition selected from the laser output and the laser irradiation time may be adjusted. In particular, it is desirable to use a fiber laser in terms of increasing the amount of energy per irradiation width.

Figure 3:
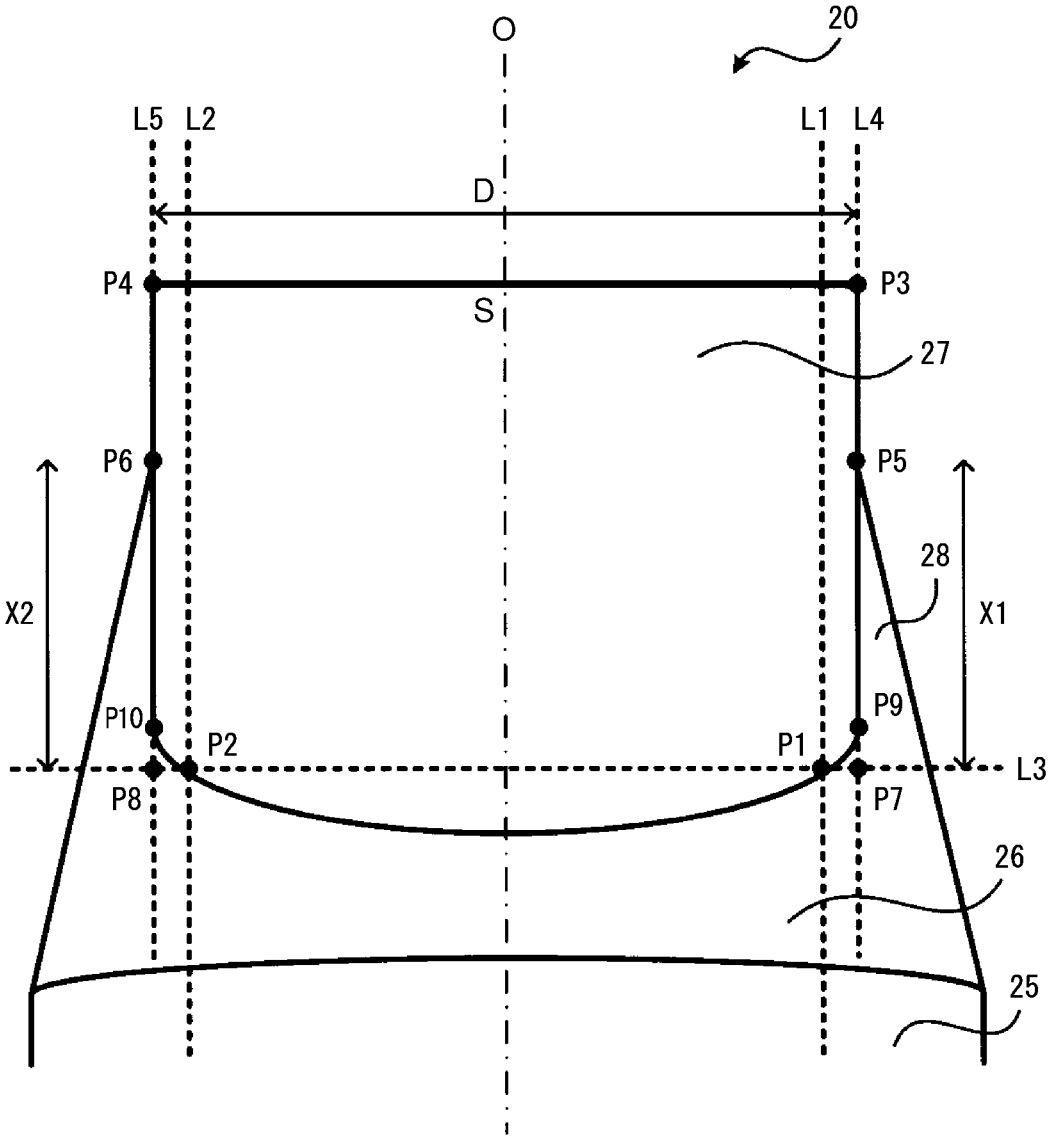
FIG. 3 is a cross-sectional view for explaining the specific shape of a melt sag.

FIG. 3 is a cross-sectional view for explaining a specific shape of the melt sag 28. FIG. 3 shows a cross section, including the center axis O, of the front end portion of the center electrode 20. In FIG. 3, a line corresponding to a front-side end surface of the precious metal tip 27 is indicated as a line S, and the line S has a length D. The melt sag 28 formed in the center electrode 20 according to the present embodiment has a shape as follows.

In the cross section shown in FIG. 3, two straight lines apart from the center axis O by a distance of "9D/20" are referred to as virtual straight lines L1 and L2, respectively. An intersection of the virtual straight line L1, L2 and the interface between the precious metal tip 27 and the melt portion 26 is referred to as an intersection point P1, P2, respectively. A straight line connecting the intersection points P1 and P2 is referred to as a straight line L3.

Of both end points of the line S, the end point positioned on the same side as the virtual straight line L1 with respect to the center axis O is referred to as an end point P3, and the end point positioned on the same side as the virtual straight line L2 with respect to the center axis O is referred to as an end point P4. A straight line which passes the end point P3, P4 and is parallel to the center axis O is referred to as a virtual straight line L4, L5, respectively. Of end points at the front side of the melt sag 28 on the virtual straight lines L4 and L5, the end point on the virtual straight line L4 is referred to as an end point P5, and the end point on the virtual straight line L5 is referred to as an end point P6. An intersection point of the virtual straight line L4, L5 and the virtual straight line L3 is referred to as an intersection point P7, P8, respectively. At this time, a distance X1 between the intersection point P7 and the end point P5 and a distance X2 between the intersection point P8 and the end point P6 are each 0.092 mm or more.

Further, in the cross section shown in FIG. 3, at the interface between the precious metal tip 27 and the melt portion 26, a rear end of a portion overlapping the virtual straight line L4 is referred to as a point P9, and a rear end of a portion overlapping the virtual straight line L5 is referred to as a point P10. Regarding an area where the precious metal tip 27 and the melt portion 26 are in contact with each other, an area between the points P5 and P9 and an area between the points P6 and P10 each are an area where the surface of the precious metal tip 27 is not substantially melted. In contrast, in the area where the precious metal tip 27 and the melt portion 26 are in contact with each other, an area between the points P9 and P10 is an area where the surface of the precious metal tip 27 is melted. Therefore, in the specification of the present application, in the area where the precious metal tip 27 and the melt portion 26 are in contact with each other, the area between the points P9 and P10 is also referred to as an "interface between the precious metal tip 27 and the melt portion 26". The interface indicated by P9-P10 where the surface of the precious metal tip 27 is melted is an area which significantly contributes to the joint strength between the precious metal tip 27 and the electrode base material 25.

In the spark plug 100 according to the present embodiment, the shape of the melt sag 28 described with reference to FIG. 3 is obtained at any cross section, including the center axis O, of the front end portion of the center electrode 20.

According to the spark plug 100 of the present embodiment configured as described above, the melt sag 28, which is a part of the melt portion 26 extending frontward, is formed on the side surface of the precious metal tip 27 disposed at the front end portion of the center electrode 20. Therefore, entry of the air into the interface between the precious metal tip 27 and the melt portion 26 can be suppressed, thereby suppressing formation of the oxide scale that is lower in strength than the precious metal tip 27 and the melt portion 26, at the interface between the precious metal tip 27 and the melt portion 26. As a result, when the heating and cooling cycles are repeated in the spark plug 100, it is possible to suppress occurrence of crack due to a difference in thermal expansion coefficient between the precious metal tip 27 and the electrode base material 25 at the interface between the precious metal tip 27 and the melt portion 26. By suppressing occurrence of crack, entry of the air into the interface between the precious metal tip 27 and the melt portion 26 is suppressed, whereby further growth of the oxide scale can be suppressed. By suppressing extension of crack in this way, falling off of the precious metal tip 27 is suppressed, whereby reliability of the joint between the precious metal tip 27 and the electrode base material 25 can be improved.

That is, it is conceivable that the melt sag 28 has a function as a seal portion which suppresses entry of the air into the interface between the precious metal tip 27 and the melt portion 26. Therefore, by forming the melt sag 28 to be long along the center axis O, the effect of suppressing growth of the oxide scale and extension of crack at the interface between the precious metal tip 27 and the melt portion 26 can be improved.

In particular, in the present embodiment, the condition that the length (corresponding to the distance X1, X2 in FIG. 3) of the melt sag 28 from a predetermined reference position corresponding to the virtual straight line L3 shown in FIG. 3 along the direction of the center axis O is 0.092 mm or more, is satisfied over the entire circumference on the side surface of the precious metal tip 27. Therefore, growth of the oxide scale can be effectively suppressed over the entire interface between the precious metal tip 27 and the melt portion 26.

As described above, according to the present embodiment, the melt sag, which has been considered to be undesirable in terms of appearance, is intentionally formed to a predetermined length or more, whereby reliability of the joint of the precious metal tip 27 is improved, resulting in increase in durability of the spark plug 100.

The larger the length of the melt sag 28 in the direction of the center axis O is, the more the effect of suppressing growth of the oxide scale at the interface between the precious metal tip 27 and the melt portion 26 can be improved. It is particularly desirable that the length of the melt sag 28 (the distance X1, X2 in FIG. 3) is 0.110 mm or more. With such a configuration, even when the temperature at which the precious metal tip 27 is exposed is high in the heating and cooling cycles, reliability of the joint between the precious metal tip and the electrode base material can be secured. However, the upper limit of the length of the melt sag 28 (the distance X1, X2 in FIG. 3) is preferably equal to the distance between the virtual straight line L3 and the point P3, P4 which is the end point of the line S corresponding to the front-side end surface of the precious metal tip 27. In other words, it is desirable that the melt sag 28 is not present on the front-side end surface of the precious metal tip 27. The cause of this is to suppress the melt sag 28 from adversely affecting ignitability in the spark plug 100.

The above-described length of the melt sag 28 is the length for securing the function thereof as the seal portion that suppresses entry of the air into the interface between the precious metal tip 27 and the melt portion 26. Therefore, the effect achieved by setting the length of the melt sag 28 in the direction of the center axis O to the above-described value is the effect achieved regardless of the size of the precious metal tip 27 and the material of the precious metal tip 27.

In the present embodiment, the virtual straight line L3 is a position to be a reference for specifying the length, in the direction of the center axis O, of the melt sag 28 formed on the side surface of the precious metal tip 27. The virtual straight line L3 is specified as follows.

As already described, the effect obtained by providing the melt sag 28 is achieved when the melt sag 28 covers the side surface of the precious metal tip 27 to suppress entry of the air into the interface between the precious metal tip 27 and the melt portion 26. Therefore, it is considered that the reference that defines the length of the melt sag 28 should be determined on the basis of the position of the interface between the precious metal tip 27 and the melt portion 26 at the rear-side end portion of the precious metal tip 27. However, the shape of the interface between the precious metal tip 27 and the melt portion 26 can vary depending on the welding condition. In particular, in the case where the melt sag 28 is provided on the side surface of the precious metal tip 27 as in the present embodiment, when the high-temperature melt formed of the precious metal tip 27 and the electrode base material 25 being melted extends frontward on the side surface of the precious metal tip 27, the side surface of the precious metal tip 27 is melted to some degree by being in contact with the melt. The degree of the melting of the side surface of the precious metal tip 27 is greater in the position closer to the rear side where the high-temperature melt is supplied. The distance of "9D/20" from the center axis O, which defines the virtual straight line L1, L2 used for obtaining the virtual straight line L3 in the present embodiment is a value experientially obtained by the inventors of the present application, as a position at which influence of the melting of the side surface of the precious metal tip 27 due to the high-temperature melt is sufficiently reduced. In the present embodiment, the virtual straight line L3 to be the reference is obtained by connecting the intersection points P1 and P2 which are the intersection points of the virtual straight lines L1 and L2 each apart from the center axis O by the distance of "9D/20" and the interface between the precious metal tip 27 and the melt portion 26, respectively. Thus, the length, in the direction of the center axis O, of the melt sag 28 formed on the side surface of the precious metal tip 27 is specified by determining the position of the rear-side end portion on the side surface of the precious metal tip 27 while suppressing influence of the melted and deformed side surface of the precious metal tip 27 due to the high-temperature melt.

C. Modifications:

Modification 1 (Modification of Shape of Melt 26):

In the above embodiment, when the precious metal tip 27 is welded, the entire circumference of the precious metal tip 27 is uniformly irradiated with the laser beam, whereby the length of the melt sag 28 in the direction of the center axis O is almost uniform over the entire circumference of the side surface of the precious metal tip 27. However, another configuration may be adopted. The length of the melt sag 28 in the direction of the center axis O may be non-uniform. For example, in the cross section shown in FIG. 3, the distance X1 and the distance X2 may be different from each other. In all the cross sections of the precious metal tip 27 including the center axis O, the length (the distance X1, X2 in FIG. 3) of the melt sag 28 described with reference to FIG. 3 may be 0.092 mm or more. In addition, the center electrode 20 may have a portion in which the precious metal tip 27 and the electrode base material 25 are in direct contact with each other without the melt portion 26 intervening therebetween. Even in such a configuration, the same effect as in the above embodiment can be achieved as long as the melt sag 28 of the melt portion 26 has the same length, in the direction of the center axis O, as the length in the above embodiment.

Modification 2 (Modification of Welding Method):

Welding of the precious metal tip 27 and the electrode base material 25 may be performed by other welding methods than the above-described laser welding, such as electron beam welding. In this case, as long as the electron beam welding is capable of melting the precious metal tip 27 and the electrode base material 25 by irradiating the precious metal tip 27 with an energy beam, from the outer peripheral side thereof toward the inside thereof, and welding them together to form the melt portion 26 having the melt sag 28, the present invention can be applied to the electron beam welding as in the above embodiment.

Modification 3 (Modification of Electrode):

In the above embodiment, the length, in the direction of the center axis O, of the melt sag 28 formed by welding the precious metal tip 27 to the electrode base material 25 of the center electrode 20 is defined. However, another configuration may be adopted. The present invention may be applied to the ground electrode 30 instead of or in addition to the center electrode 20.

EXAMPLES

Various precious metal tips 27 having different components and sizes were welded to the electrode base material 25, thereby manufacturing a plurality of electrodes having different lengths of the melt sag 28 in the direction of the center axis O. A thermal test was performed to expose these electrodes to heating and cooling cycles, and the degree of the oxide scale formed at the interface between each precious metal tip 27 and the melt portion 26 was examined. Regarding the thermal test, two types of tests (a first thermal test and a second thermal test) having different heating conditions were performed. The thermal test was performed as a desk test in which the precious metal tips were welded onto a welding base material imitating the electrode base material 25 and heated by using a burner, instead of actually fabricating a spark plug and actually performing ignition operation using the spark plug.

[Electrodes for Test]

Figures 4, 5:
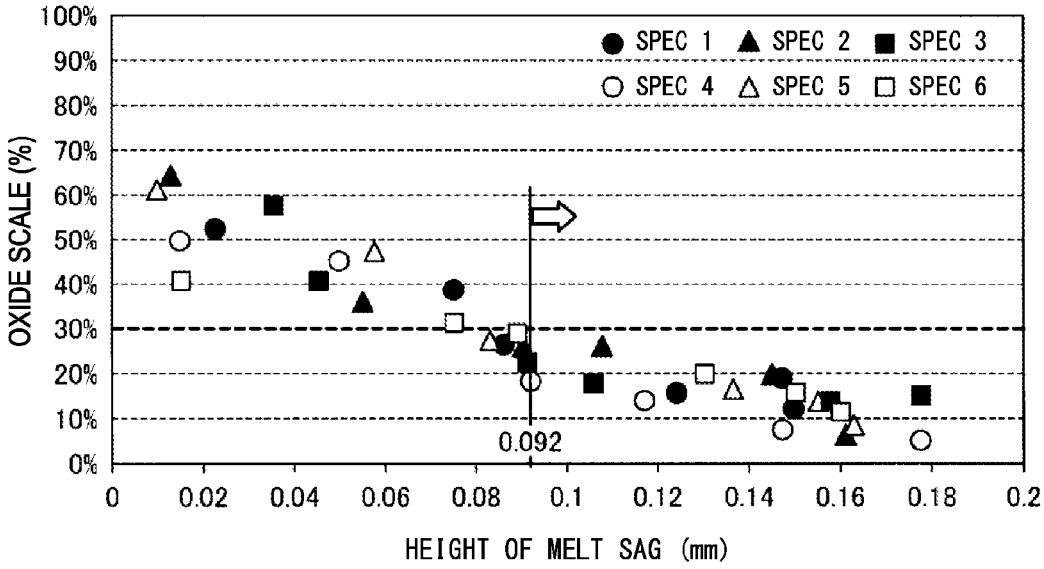
FIG. 4 is an explanatory view showing specs of electrodes subjected to a thermal test.
FIG. 5 is an explanatory view having a horizontal axis indicating the length of the melt sag, and a vertical axis indicating the oxide scale formation ratio.

FIG. 4 is an explanatory view showing the specs of the electrodes subjected to the thermal test. In the electrodes according to Spec 1 and Spec 4, the precious metal tip 27 made of iridium-platinum (Ir—Pt) alloy with the content ratio of platinum being 10 wt % was used. In the electrodes according to Spec 2 and Spec 5, the precious metal tip 27 made of iridium-rhodium (Ir—Rh) alloy with the content ratio of rhodium being 10 wt % was used. In the electrodes according to Spec 3 and Spec 6, the precious metal tip 27 made of iridium-ruthenium (Ir—Ru) alloy with the content ratio of ruthenium being 8 wt % was used. In addition, in the electrodes according to Spec 1 to Spec 3, the cylindrical precious metal tip 27 with the diameter of the end surface thereof being 0.6 mm and the height being 0.75 mm was used. In the electrodes according to Spec 4 to Spec 6, the cylindrical precious metal tip 27 with the diameter of the end surface thereof being 0.8 mm and the height being 0.5 mm was used.

In each electrode subjected to the thermal test, as the welding base material imitating the electrode base material 25, a cylindrical member made of INCONEL 600 (INCONEL is a registered trademark) as a nickel-base alloy was used. In manufacturing each electrode, the welding base material was used in which the diameter of the end surface thereof to which the precious metal tip is to be welded was 0.3 mm larger than the diameter of the end surface of the precious metal tip to be welded.

The welding conditions in manufacturing each electrode to be subjected to the thermal test are as follows. Welding was performed by using a pulse wave (PW) oscillation fiber laser. In advance of laser welding, each precious metal tip 27 was disposed on the end surface of the welding base material, and pressed and fixed by means of a pin. Then, laser welding was performed while rotating the welding base material on which the precious metal tip 27 was fixed, around the center axis O at a rotation speed of 60 rpm. For each spec, various electrodes were manufactured with different average laser outputs ranging from 30 to 45 W. In addition, for each spec, various electrodes were manufactured with different numbers of laser shots ranging from 11 to 14 shots. In each electrode, the irradiation time of laser per shot was 5 msec. The interval of laser irradiation was uniformly adjusted such that laser irradiation was finished within one rotation of the welding base material to which the precious metal tip was fixed. The laser irradiation was adjusted such that, in each electrode, a region irradiated with laser first time was about one-half overlapped with a region irradiated with laser last time.

Thus, for each spec, the various electrodes were manufactured with different average laser outputs and different number of laser shots, X-ray CT observation was performed on these electrodes, and the length of the melt sag 28 in each electrode in the direction of the center axis O was measured by nondestructive internal observation. While the melt sag 28 was substantially uniformly formed over the entire circumference on the side surface of the precious metal tip 27, the length of the melt sag 28 was measured at a position where the melt sag 28 has the shortest length in the direction of the center axis O. Then, for each of the first thermal test and the second thermal test, six electrodes having different welding conditions were selected for each spec in such a manner that the length of the melt sag 28 in the direction of the center axis O varied as uniformly as possible among the six electrodes within a range from about 0.01 mm to about 0.18 mm (in FIG. 4, for each spec, the number of electrodes is 6).

[Conditions of First Thermal Test]

All the electrodes, which were selected by six for each of Spec 1 to Spec 6 as described above, were subjected to the first thermal test. The first thermal test includes, as one cycle, an operation to heat the precious metal tip 27 with a burner and an operation to stop the heating, and was performed by 1,000 cycles. In the heating operation, heating was performed so that the temperature of the precious metal tip 27 reached 950° C. while measuring the temperature of the precious metal tip 27 with a radiation thermometer. The heating time per cycle was 2 minutes. The operation to stop the heating was one minute per cycle.

[Conditions of Second Thermal Test]

All the electrodes, which were selected by six for each of Spec 1 to Spec 6 as described above, were subjected to the second thermal test. The second thermal test is different from the first thermal test only in that the temperature of heating was 1,000° C. That is, the heating condition is stricter in the second thermal test than in the first thermal test.

[Measurement of Oxide Scale]

After the first and second thermal tests were executed each by 1,000 cycles, the cross section, including the center axis, of the precious metal tip 27 of each electrode was exposed. Then, in the exposed cross section, the length X1, X2 of the melt sag 28 in the direction of the center axis O was actually measured as shown in FIG. 3. The actually measured value coincided well with the numerical value measured by the X-ray CT nondestructive internal observation. The exposed cross section was enlarged by 70 times and observed, and the length of the oxide scale formed at the interface between the precious metal tip 27 and the melt portion 26 was measured. Then, the ratio of the total length of the oxide scale formed between the points P9 to P10 to the length of the interface (between the points P9 and P10 in FIG. 3) between the precious metal tip 27 and the melt portion 26 was calculated as an oxide scale formation ratio. At the interface between the precious metal tip 27 and the melt portion 26 exposed at the cross section of the electrode, the color of the oxide scale is different in color from other portions and therefore can be easily distinguished.

FIG. 5 is an explanatory view in which, regarding each electrode subjected to the first thermal test, the actually measured length (the minimum value of the distance X1, X2 in FIG. 3) of the melt sag 28 of the electrode in the direction of the center axis O is indicated on the horizontal axis, and the calculated oxide scale formation ratio is indicated on the vertical axis. In the first thermal test, the electrodes with the oxide scale formation ratios being 30% or less were evaluated as "passed". As shown in FIG. 5, in each spec, the electrodes with the length of the melt sag 28 in the direction of the center axis O being 0.092 mm or more were evaluated as "passed". Therefore, it was confirmed that the effect of suppressing growth of the oxide scale was improved by setting the length of the melt sag 28 to be 0.092 mm or more. No difference was observed in the above tendency among the specs of the precious metal tip 27, i.e., among the different components and sizes of the precious metal tip 27.

Figure 6:
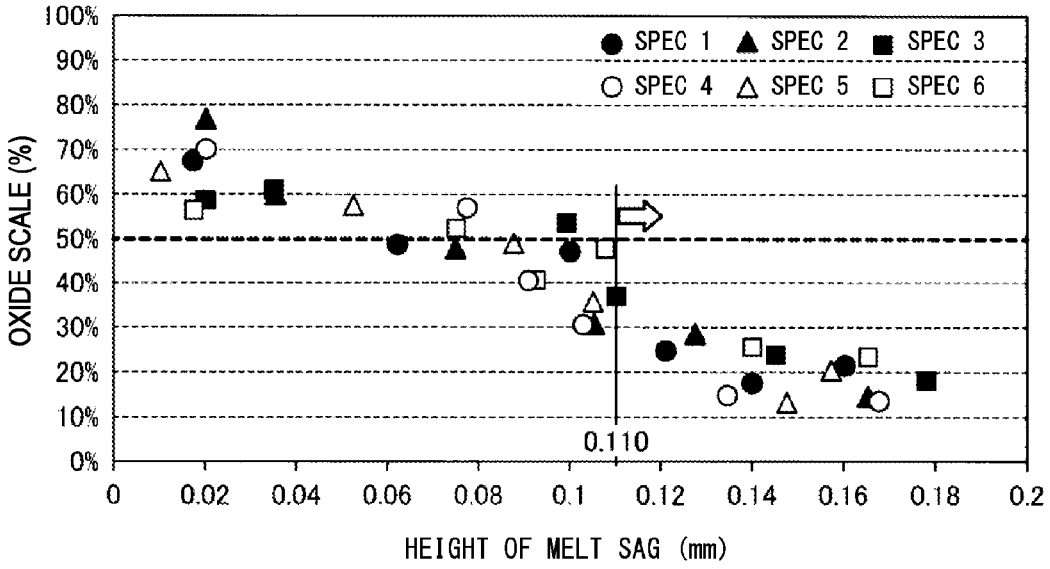
FIG. 6 is an explanatory view having a horizontal axis indicating the length of the melt sag, and a vertical axis indicating the oxide scale formation ratio.

FIG. 6 is an explanatory view in which, regarding each electrode subjected to the second thermal test, the actually measured length (the minimum value of the distance X1, X2 in FIG. 3) of the melt sag 28 of the electrode in the direction of the center axis O is indicated on the horizontal axis, and the calculated oxide scale formation ratio is indicated on the vertical axis. In the second thermal test, the electrodes with the oxide scale formation ratios being 50% or less were evaluated as "passed". As shown in FIG. 6, in each spec, the electrodes with the length of the melt sag 28 in the direction of the center axis O being 0.110 mm or more were evaluated as "passed". Therefore, it was confirmed that, even when the electrodes were subjected to severe heating and cooling cycles with the heating temperature reaching 1000° C., the effect of suppressing growth of the oxide scale was improved by setting the length of the melt sag 28 to be 0.110 mm or more. No difference was observed in the above tendency among the specs of the precious metal tip 27, i.e., among the different components and sizes of the precious metal tip 27.

The present invention is not limited to the above embodiments, modes, and modifications/variations and can be embodied in various forms without departing from the scope of the present invention. For example, it is feasible to appropriately replace or combine any of the technical features of the aspects of the present invention described in "Summary of the Invention" and the technical features of the embodiments, modes, and modifications/variations of the present invention in order to solve part or all of the above-mentioned problems or achieve part or all of the above-mentioned effects. Any of these technical features, if not explained as essential in the present specification, may be deleted as appropriate.

DESCRIPTION OF REFERENCE NUMERALS

3 . . . ceramic resistor
4 . . . seal body

5 . . . gasket
6 . . . ring member
8 . . . sheet packing
9 . . . talc
10 . . . ceramic insulator
12 . . . axial hole
13 . . . leg portion
15 . . . ceramic step portion
17 . . . front trunk portion
18 . . . rear trunk portion
19 . . . central trunk portion
20 . . . center electrode
25 . . . electrode base material
26 . . . melt portion
27 . . . precious metal tip
28 . . . melt sag
30 . . . ground electrode
40 . . . metal terminal
50 . . . metallic shell
51 . . . tool engagement portion
52 . . . threaded attachment portion
53 . . . crimp portion
54 . . . gasket receiving portion
56 . . . metal-shell internal step portion
57 . . . front end surface
58 . . . compressive deformation portion
100 . . . spark plug
200 . . . engine head
201 . . . threaded attachment hole
600 . . . INCONEL Having described the invention, the following is claimed:

1. A spark plug, comprising:

an electrode, comprising:

a cylindrical precious metal tip defined by two end surfaces and a side surface, the cylindrical precious metal tip containing a precious metal and allowing discharge at a first of the two end surfaces with respect to a center axis of the precious metal tip, an electrode base material having a front end surface with an outer diameter that is in contact with an entirety of an outer diameter of a second of the two end surfaces of the precious metal tip, the electrode base material extending in a direction of the center axis of the precious metal tip, the electrode base material having a center axis that extends in the direction of the center axis of the precious metal tip and is independent of the center axis of the precious metal tip, and a melt portion joining the second end surface of the precious metal tip and the front end surface of the electrode base material, the melt portion comprising a melt sag disposed over an entire circumference of an area of the side surface, wherein, in arbitrary cross-sections including the center axis of the precious metal tip of the electrode:

a length of a line S corresponding to the first end surface is D, two straight lines apart from the center axis of the precious metal tip by a distance of (9*D)/20 are virtual straight lines L1, L2, respectively, points at which the virtual straight lines L1, L2 respectively intersect with interfaces between the precious metal tip and the melt portion are intersection points P1, P2, respectively, a straight line connecting the intersection points P1 and P2 is a virtual straight line L3, of end points of the line S, the end point located on the same side as the virtual straight line L1 with respect to the center axis of the precious metal tip is an end point P3, and the end point located on the same side as the virtual straight line L2 with respect to the center axis of the previous metal tip is an end point P4, straight lines respectively passing through the end points P3, P4 and parallel to the center axis are a virtual straight lines L4, L5, respectively, of end points of the melt sag at the one end side on the virtual straight lines L4 and L5, the end point on the virtual straight line L4 is an end point P5, and the end point on the virtual straight line L5 is an end point P6, points at which the virtual straight lines L4, L5 respectively intersect with the virtual straight line L3 are intersection points P7, P8, respectively, and each of a distance X1 between the intersection point P7 and the end point P5 and a distance X2 between the intersection point P8 and the end point P6 is 0.092 mm or more.

2. The spark plug according to claim 1, wherein each of the distances X1 and X2 is 0.110 mm or more.

3. The spark plug according to claim 1, wherein the outer diameter of the precious metal tip is less than the outer diameter of the electrode base material.

4. The spark plug according to claim 1, wherein the center axis of the precious metal tip and the center axis of the electrode base material deviate from each other while the second end surface of the precious metal tip is located inward of the front end surface of the electrode base material.

* * * * *